US009867408B2

(12) United States Patent
Pratson et al.

(10) Patent No.: US 9,867,408 B2
(45) Date of Patent: Jan. 16, 2018

(54) KNEE PAD DEVICE

(71) Applicants: David Pratson, Bonsall, CA (US); Craig Beal, Oceanside, CA (US); D. J. Moore, Knoxville, TN (US)

(72) Inventors: David Pratson, Bonsall, CA (US); Craig Beal, Oceanside, CA (US); D. J. Moore, Knoxville, TN (US)

( * ) Notice: Subject to any disclaimer, the term of this patent is extended or adjusted under 35 U.S.C. 154(b) by 260 days.

(21) Appl. No.: 14/221,090

(22) Filed: Mar. 20, 2014

(65) Prior Publication Data

US 2014/0283275 A1 Sep. 25, 2014

Related U.S. Application Data

(60) Provisional application No. 61/803,738, filed on Mar. 20, 2013.

(51) Int. Cl.
*A41D 13/00* (2006.01)
*A41D 13/06* (2006.01)

(52) U.S. Cl.
CPC ..... *A41D 13/065* (2013.01)

(58) Field of Classification Search
CPC ..... A41D 27/26; A41D 13/065; A41D 13/06; A63B 71/1225; A63B 2071/125; A63B 2071/1258
USPC ..... 2/24, 22, 62, 267, 268, 269, 270, 911
See application file for complete search history.

(56) References Cited

U.S. PATENT DOCUMENTS 5,297,294 A * 3/1994 Washick ..... A63B 71/1225 2/22
5,455,969 A * 10/1995 Pratson ..... A41D 13/065 2/24
7,096,508 B2 * 8/2006 Lesosky ..... A41D 13/065 2/24
2013/0007938 A1 * 1/2013 LoCicero ..... A41D 13/06 2/24

* cited by examiner

*Primary Examiner* — Khaled Annis
(74) *Attorney, Agent, or Firm* — Donn K. Harms

(57) ABSTRACT

A knee pad provided for engagement to a user in an as-worn position with an interior surface surrounding the front of the user's knee. A plurality of projections extend from the body and are made of compressible material to provide a cushioned support to the knees of the user during use.

18 Claims, 4 Drawing Sheets

KNEE PAD DEVICE

This application claims priority to U.S. Provisional Patent application Ser. No. 61/803,738 filed on Mar. 20, 2013, and incorporated herein in its entirety by this reference thereto.

BACKGROUND OF THE INVENTION

1. Field of the Invention

The present invention relates generally to knee pads and knee protection devices. More particularly, the invention relates to a knee pad device for both protecting the user's knees from injury and concurrently improving user stability when in a kneeled or knee support position, comprising means for communicating the users weight to a plurality of contact surfaces.

In addition to providing the knees a shield to impact and puncture injury, the device herein also includes a plurality of contact surfaces which are preferably co-planarly aligned. In use with these surfaces the device provides significantly improved stability by distributing the weight throughout the plurality of contact surfaces over a wide footprint. The invention also relates to a knee protective device employing means for shock absorbency for reducing fatigue by reducing the perceived weight communicated to the users knee as experienced by the user during prolonged knee supported positions. Additionally, the invention relates to the employment of slip resistance means with knee pad devices for reducing slip between the contact surfaces and the support surface for improving safety. Further, the device may be configured with removable engagement means for the various components to facilitate replacement as needed.

2. Prior Art

Knee pads and knee protection devices are a type of protective equipment which are typically worn around the leg at the knee, or strapped directly to the knee. Generally such devices provide some sort of knee protection and support depending on the venue of employment. In a sports venue, knee pads are conventionally worn to protect the athlete against impact injury related to a fall or side-strike by an opponent. In another example, in some extreme sports such as skateboarding and inline skating, knee pads are worn by the athletes to protect their knee from impact and abrasive injuries from ground contact after a fall. In another mode of use such as with construction, knee pads can be worn to provide padding to the skin and underlying bones during extending periods of kneeling, as well as protection form injury when kneeling in nail-laden construction sites.

For the latter, it is well known that construction workers and other labor professionals are often required to work on their knees for long periods. For example, workers who install floor coverings are often required to maintain a kneeling position for hours of time during the preparation and subsequent installation of a floor covering in a room. Maintaining this position while performing labor-intensive installation can be extremely uncomfortable.

Kneeling workers often experience knee injuries caused by maintaining such a position for prolonged periods. Further, users are additionally known to experience both back and neck injuries due to the user constantly straining to lean or work adjacently while concurrently trying to keep excess pressure off their knees and maintain a comfortable working position while on their knees. As such, many individuals who perform this work will wear some type of knee pad device which provides some padding to reduce the stresses on the skin and bones of their knees which is experienced during such prolonged periods of kneeling. As a result of being able to place more weight on padded knees, users tend to experience less back and neck pain since the support and comfort at their knees allows them to maintain an overall comfortable working position and more proper posture during extension.

However, currently available conventional knee pads and support devices intended to support the knee during extended periods of kneeling still fail significantly in many aspects. Many conventional knee pads and knee protection devices provide some type of support and protection when in a stationary kneeling position. However many do not take into account that the user may be constantly moving their upper body in differing leaning directions over the contact of their knees with the supporting surface while performing various tasks in the kneeled position. If a user leans or reaches for an item, lifts or moves items while kneeling, or shifts their upper body frequently, the weight distributed to each knee, and therefor to each knee pad in contact with a support surface, will change constantly. With conventional devices, this transfer of weight from one pad to the other can cause many problems.

First, many knee pads and related devices have substantially rounded exterior surfaces, since the pad as a whole is generally designed to conform with the natural curvature of the human knee when worn. In use, the curved exterior surface of the pad devices when in contact with a support surface provides only a single contact surface area per pad. Although some conventional devices are known to have flexible surface materials capable of slightly flattening during contact with the support surface, to slightly increase the surface area of contact, such pads have a substantially smooth plastic surface and still only a single contact surface area per pad is provided.

As such, many conventional knee pad devices are inherently unstable. The knee pad devices can rock and sway about the singular contact point and if the user leans too far in one direction the smooth surface of the conventional pads can slip in their frictional engagement with the support surface. The curved exterior surface makes it extremely difficult for the user to maintain a stable kneeling position as the pads will tend to rock along the curved and limited exterior contact surface area and will cause discomfort at the knee. This is especially true when the user's upper body is moving and the distribution of weight is constantly changing.

Further, in leaning to one side or the other, or if the user become slightly unbalanced for any reason, one or both knee pads may lift from their contact engagement with the support surface and one or both may possibly slip. This problem of sideways slip is enhanced if the support surface is slick or wet. Any such slipping instance can cause the user to fall, or drop an item and potentially cause injury to themself or others.

Still further, knee pads which are used on a daily basis often become worn and unusable after some time due to conventional wear and tear. This wear and tear especially includes the exterior surface, which is used for frictional and contact stability with the support surface, becoming worn or scratched to the point where the device cannot adequately engage a support surface without slipping. In addition, any padding or other support material may become worn such that the device is no longer comfortable in its engagement to the users knee. This conventionally results in the user discarding the worn knee pads and purchasing knew ones. Such actions are quite wasteful, since in most cases the structural body of the knee pad may be fully intact and suitably usable, while it is merely exterior surfaces or padding which are worn to render it unsafe and/or uncomfortable As a result, there is a continuing unmet need for a knee pad device which provides improved stability, and improved slip resisting support to the user during use. Such a device should overcome the shortfalls in prior art and improve user stability by communicating the downward force of the users weight to a plurality of contact surfaces, as opposed to a single contact surface. Such a plurality of contact surfaces should advantageously should follow the curve or shape of the exterior of the knee pad to provide a planar or full contact footprint area of engagement with the support surface which eliminates rocking or swaying of the device when supported on the support surface. Such a device should employ one or a plurality of pad components to comfortably cushion the users knee when compressed by their weight toward the support surface. Such a knee pad device should employ means for shock absorbency for reducing user fatigue by reducing the perceived weight communicated to the users knee as experienced during prolonged knee support. Such a device should employ means for slip resistance for reducing slip between the contact surfaces and the support surface for improving safety. Further, such a device should be configured with means for removable engagement of the various components to facilitate easy replacement after they become worn, and thereby reduce the amount of such devices sent to landfills.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described provides a solution to the shortcomings in prior art and achieves the above noted goals through the provision of a knee pad device for improving user stability when in a kneeled or knee support position over prolonged periods of time. It accomplishes this goal by communicating the force of the users weight to a plurality of contact surfaces with the support surface instead of one. The device is preferably configured with means for removable engagement of many of its key components as needed to facilitate replacement after they become worn and unusable.

In accordance with a first preferred, and simplest mode, the device comprises a body having a circumferential side edge communicating between an exterior surface and an interior surface. The interior surface is preferably adapted for a comfortable engagement to a users knee in shape and material, while the exterior surface is adapted for an engagement with the ground or other support surface. Means for operative engagement of the device to a users knee can include one or a plurality of elongated engagement straps which can be wrapped around the leg at or adjacent the users knee, or on the parts of the users leg slightly above and below the knee. The straps may employ hook and loop fasteners, snaps, or other suitable fastening means for their respective distal ends and may be elastic to provide a means to bias the knee pad toward the user's knee. Such should allow the body of the device to be securely engaged to the users knee once the desired tightness, and/or stretching of the straps are achieved.

The exterior surface of the body of the device, preferably employs means for communicating the force of the users weight to a plurality of contact surfaces herein provided by a plurality of stabilizing projections engaged to and extending from the exterior surface. The projections are preferably in the form of elongated strips aligned in a central position on the exterior of the body.

In one preferred mode, the distal ends of the projections include raised ends defining a central hollow channel which spaces the ends a distance apart. The raised ends preferably have at least one contact surface which is substantially planar.

The plurality of planar contact surfaces of the projections are preferably co-planarly aligned and define an overall footprint area of the device when engaged on a support surface. The area of the footprint is defined by the number and spacing of the projections comprising an overall length, multiplied by a width determined by the distance of the channel. It is noted that the size of the contact footprint area can vary by employing projections of various dimensions as deemed suitable by the designer to provide improved user stability.

As such, the co-planarly aligned flat contact surfaces of the projections provides a means for communicating and distributing the users weight over a plurality of contact surfaces over the desired stabilizing footprint area. In addition, the provision of the plurality of planar contact surfaces when engaged to the support surface, provide an engagement which is inherently resistant to rocking and swaying due to the plural points of engagement with the support surface.

The plural points of engagement provided by the co-planar surfaces maintain improved stable support even when the user reaches for an item, lifts or moves items in their workspace, or moves their upper body frequently. In use, the weight communicated to each knee and therefor to each knee pad device is continually distributed throughout the plurality of contact surfaces on the projections. For example, in an extreme case where the user leans to the point where some of the contact surfaces are lifted off of the support surface, the remaining contact surfaces still in contact with the support surface will continue to distribute the weight such that stable support is maintained. Further, in all modes, the material employed is compressive or elastic and provides a means for padding the knees and their force toward the support surface.

In at least one preferred mode, the body is formed from planar material which is bent or otherwise constructed to conform to the shape of the human knee, and slightly or moderately wrap around the knee when in the as worn position. The device may be formed from conventional plastics via conventional forming techniques such as injection molding, or other suitable forming means.

It is noted those skilled in the art may envision additional or modified shapes and configurations of the body, as well as other means for communicating the users weight to a plurality of contact surfaces which are suitable for the intended purpose of reducing rock and sway of the device in the as worn position. As such, other embodiments envisioned by those skilled in the art are anticipated in this disclosure while the descriptions and depictions in the figures provided herein should not be considered limiting in any manner.

In another preferred mode the device employs a pad component engageable to the interior surface of the body. In use the pad component will be in a sandwiched engagement between the body of the device and the users knee when worn to provide support and cushioning comfort for the users knee. The pad component is preferably ergonomically shaped and substantially formed to the shape of the human knee to provide the utmost comfort since users may have to maintain a kneeled position for long periods of time. Further, the pad is compressive or elastic and preferably includes air cooling means, provided by one or a plurality of air vent channels communicating with vent apertures to communicate air through the pad to the users knee for cooling applications.

In still another preferred mode, the device may include an upper component engaged to the body of the device which is intended to engage the user thigh, just above the knee. The upper component preferably engages over the users thigh to provide a protective barrier for it. It is known that users who work on their knees typically have a work space in front of them and conventional knee pads do not cover a large area of the thigh.

As such the thigh may be exposed to inadvertent injury during use of power tools, hand tools, welding or other equipment used in the workspace. Additional utility is provided through the employment of a sealing strap, which communicates over an upper terminating edge of the upper component to provide a sealed engagement of the upper component against the users thigh. This provides a means for preventing sparks or slag during welding, or other debris from lodging between the upper component and the users thigh.

Further, due to the typically labor intensive work associated with users who work on their knees, as noted means for shock absorbency for reducing user fatigue, are additionally preferably provided. Means for shock absorbency will essentially reduce the perceived weight communicated to the user's knee when the user moves around or shifts their weight during a prolonged knee support position.

In at least one mode, the means for shock absorbency is provided by forming the raised ends of the stabilizing projections with a material and construction which is adapted with slight or moderate compression and rebound characteristics. For example, a resilient rubber or similar material such as ABSORBATHANE which will compress under the weight of the user and absorb impact forces when the device contacts the ground may be suitable for this purpose. However, other embodiments envisioned by those skilled in the art which serve the intended purpose may also be employed, and are anticipated.

In yet another mode, means for slip resistance between the contact surfaces of the device and the support surface are additionally provided. This may be provided through the employment of friction enhancing contact surface materials. For example, the flat planar contact surfaces of the projections may be configured with a friction enhancing material, such as a soft rubber or the like, which is imbedded into the contact surfaces in a 2-shot injection molding process when forming the projections using conventional injection molding techniques. However, other embodiments envisioned by those skilled in the art which serve the intended purpose of reducing slip may also be employed, and are anticipated.

In still another preferred mode, the device is configured with means for removable engagement of at least one of the plurality of stabilizing projections and the pad component, as needed to facilitate replacement after they become worn and unusable. As such, in this mode the device may be providable to the user in a kit mode, including the body of the device, the upper component, one or a plurality of engagement straps, one or a plurality of removably engageable padding components, and one or a plurality of removably engageable stabilizing projections. The kit may include various constructions of the stabilizing projections and padding components, each formed of different durometer or hardness of materials which provide different friction enhancing and shock absorbency characteristics, and comfort level deemed suitable by the user. In addition, the projections can be provided having different geometries thereby allowing the user to vary the size of the footprint as needed. As such a plurality of stabilizing projections and pad components can be provided as replacements.

It is briefly noted that upon reading this disclosure, those skilled in the art will recognize various means for carrying out these intended features of the invention. As such it is to be understood that other devices may be configured to carry out these features and are therefor considered to be within the scope and intent of the present invention, and are anticipated.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

The objects, features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative rather than limiting. In the drawings.

Figure 1:
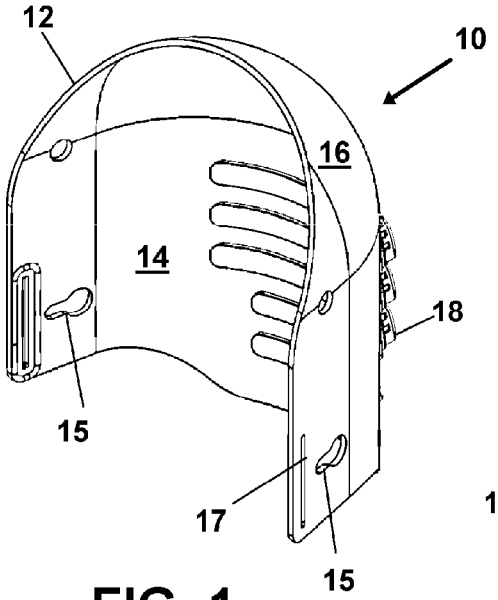
FIG. 1 shows a rear perspective view of a particularly preferred mode of the knee pad device comprising a device body employing a plurality of stabilizing projections.
Figure 2:
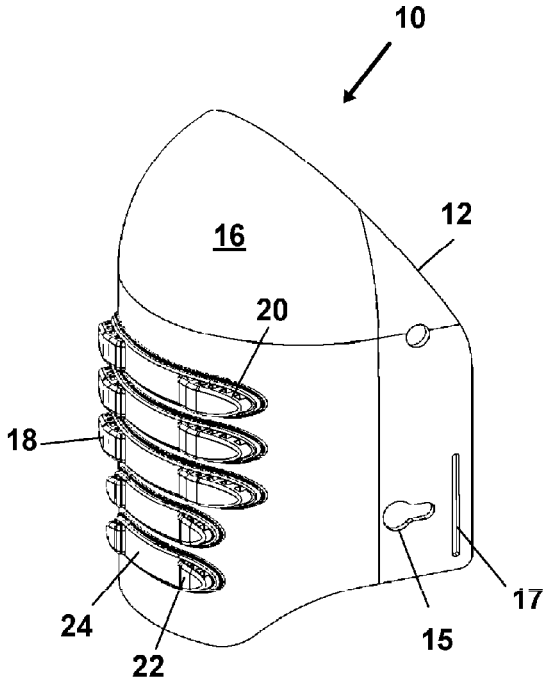
FIG. 2 shows a front perspective view of the mode of the device of FIG. 1.
Figure 3:
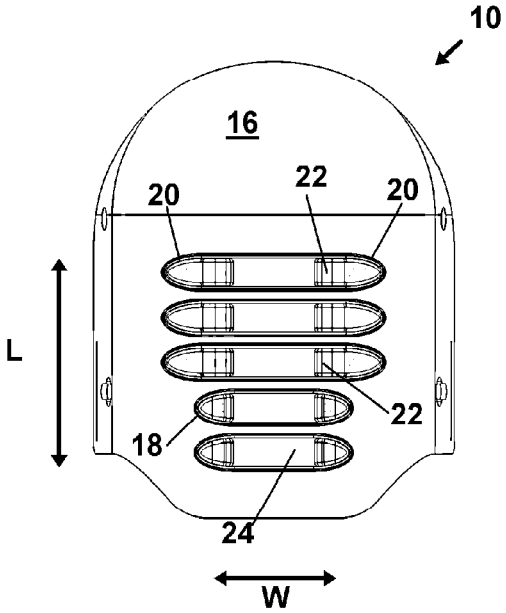
FIG. 3 shows a front view of the mode of the device of FIG. 1.
Figure 4:
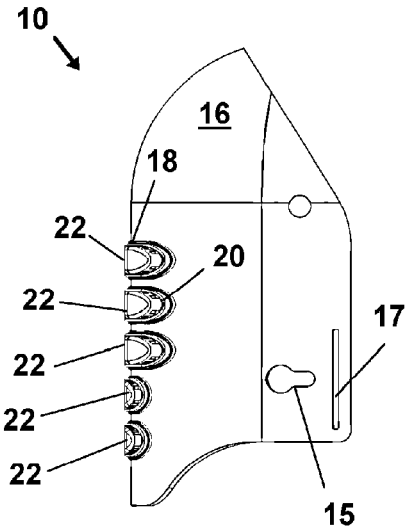
FIG. 4 shows a side view of the device of FIG. 1.

Other aspects of the present invention shall be more readily understood when considered in conjunction with the accompanying drawings, and the following detailed description, neither of which should be considered limiting.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Now referring to drawings in FIGS. 1-10, wherein similar components are identified by like reference numerals, there is seen in FIG. 1, FIG. 2, FIG. 3, and FIG. 4 views of one particularly preferred mode of the knee pad device 10 herein for improving user stability and comfort when in a kneeled or knee supported position over prolonged periods of time. As can be seen with the device 10 operatively engaged, communication of force of the users weight is to a plurality of contact surfaces 22.

In accordance with this mode shown in the noted figures, the device 10 includes a body 12 being a substantially thin shell having a circumferential side edge defining a shape and communicating between a interior surface 14 and an exterior surface 16. The various components of the device disclosed herein can be formed of conventional materials such as synthetic materials like carbon fiber, plastics such as PVC, ABS, or polypropylene, however can be formed of any material suitable for the purposes set forth in this disclosure. In the current mode, the body 12 is constructed to conform to the curved shape of the human knee, and formed to slightly or moderately wrap around the exterior of the knee when in the as-worn position with the knee in contact with the interior surface 14 and straps engaged.

Figure 8:
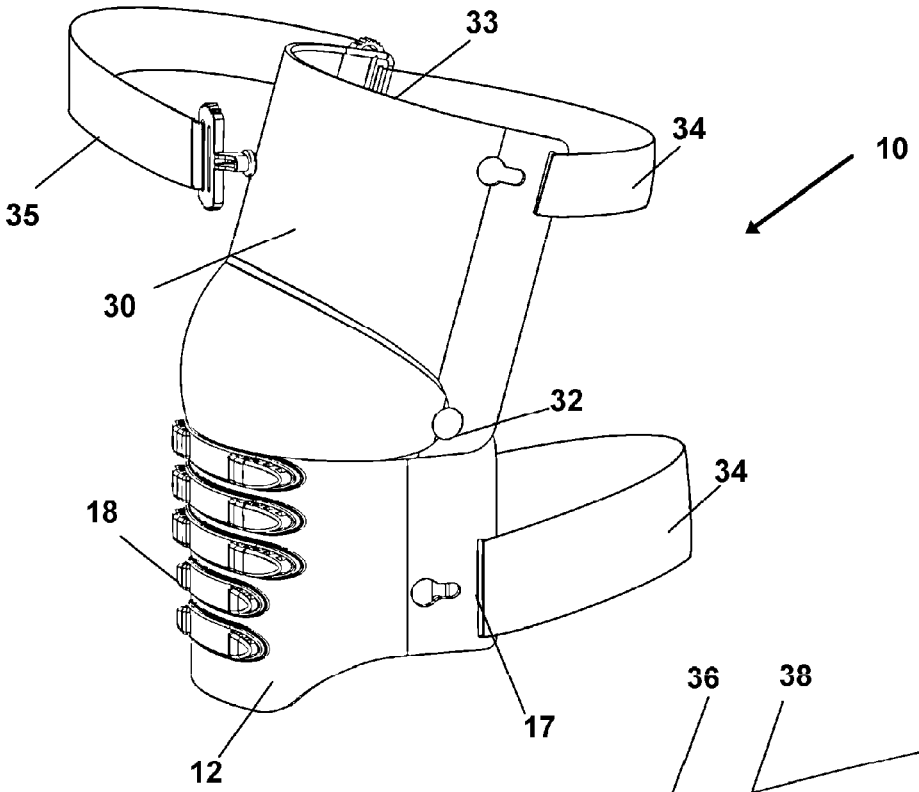
FIG. 8 shows a first side perspective view of the yet another mode of the device comprising a rotatably engageable upper component. As shown is a preferred sealing strap employed to engage over the upper terminating edge to keep out debris.
Figure 9:
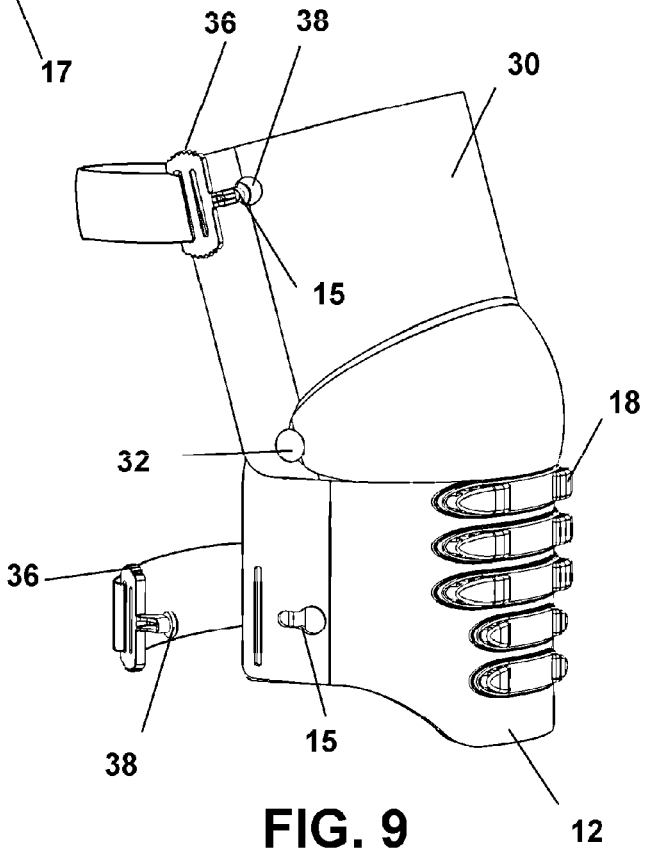
FIG. 9 shows a second side perspective view of the mode of the device of FIG. 8.

The interior surface 14 is preferably adapted for an as-worn engagement with a users knee in manner similar to conventional knee pad devices for providing knee support when in a kneeled or knee supported position. Means for engagement of the device 10 to a users knee with the interior surface 14 adjacent the knee, can include one or a plurality of elongated engagement straps 34 (FIGS. 8 and 9). These straps may be elastic or fixed in length and may be engaged around the rear of the users knee at the knee or on the parts of the users leg slightly above or below the knee. However, those skilled in the art may envision other means for engagement which are suitable for the intended purpose and are therefor anticipated within the scope of this disclosure. Further, in other modes the device 10 may be employed in a free-standing manner without means for engagement where instead the device 10 is placed on the floor and the user kneels into an engagement with the device 10 when needed.

The straps 34 as noted may be elastic in whole or in part whereby they elongate and when the distal ends are engaged with two straps 34 the device 10 is biased toward the front of the user's knee.

The exterior surface 16 of the body 12 is curved similar to the interior surface 14 and preferably includes means for communicating the force of the users weight upon the device 10 when in a kneeling position, to a plurality of contact surfaces 22. The contact surfaces 22 herein are preferably provided by one or a plurality of projections 18 engaged to and extending from the exterior surface 16. As clearly shown in the drawings, the projections 18 are preferably in the form of individual elongated strips which are aligned in a central location on the exterior 16 of the body 12. This allows individual strips to be replaced, however the projections 18 can be formed by a single unit having recesses therein to form the plurality of projections 18 at a distal end.

While the device 10 is a huge improvement in the art with the projections 18, the distal ends of the projections 18 may also preferably include shoulders shown as raised ends 20 on opposite ends of the projections 18 which define a recess therebetween where the distal end of the projection 18 is lower than the two shoulders in a channel 24. The shoulder provided by the raised ends 20 preferably have at least one contact surface 22 which is substantially planar and aligns along an imaginary line, with an opposing contact surface 22 on the projection 18 on the opposite side of the recess defined by the channel 24.

The plurality of shoulders with planar contact surfaces 22 on the projections 18 which are preferably co-planarly aligned define an overall contact footprint area of the device 10 when positioned on a support surface with the device 10 in the as-worn position. The area of the footprint is defined by the number and spacing of the projections comprising an overall length 'L', multiplied by a width 'W' determined by the distance of the channel 24 or recessed portion of the projection 18.

It is noted that the size of the footprint can vary by employing projections of various quantities and dimensions as deemed suitable by the designer to provide improved user stability.

The channel 24 spaces the ends 20 a distance apart defining the width 'W' which can be varied to essentially widen the overall area of the footprint for improving stability and distribution of weight to the co-planarly aligned contact surfaces 22. Therefor the widened contact surface area and footprint providing a distribution of weight to the plural contact points provides an overall improved and stability-enhanced engagement with a support surface compared to that of conventional knee pad devices which typically provide a single contact surface which may be curved or otherwise have a substantially smaller contact footprint.

The plurality of flat planar surfaces 22 on the shoulders of the projections 18, aligned across respective recesses in a common plane, define an overall contact surface area for the device with the support surface, which is highly resistant to rocking and swaying. This is due to the plural points of planar contact of the shoulders on each side of a recess defined by the channel 24 in the support surface. It is noted and anticipated that the distance of the channel 24 portion and therefor spacing between the contact surfaces 22 on the shoulders, can be modified by the designer as deemed suitable for providing a wider width 'W' and therefor a larger contact footprint area.

In addition, the plural points of contact via the co-planar surfaces 22 on the shoulders, maintain improved stable support even when the user reaches for an item, lifts or moves items in their workspace, or moves their upper body frequently. In use, the weight communicated to each knee and therefor to each knee pad device 10 is continually distributed throughout the plurality of contact surfaces 22 on the projections 18. For example, in an extreme case where the user leans to the point where some of the surfaces 22 are lifted out of contact with the support surface, the remaining plurality of other surfaces 22 remain in contact with the support surface and will continue to distribute the weight throughout such that slipping and sliding is avoided and stable support is maintained.

Figure 5:
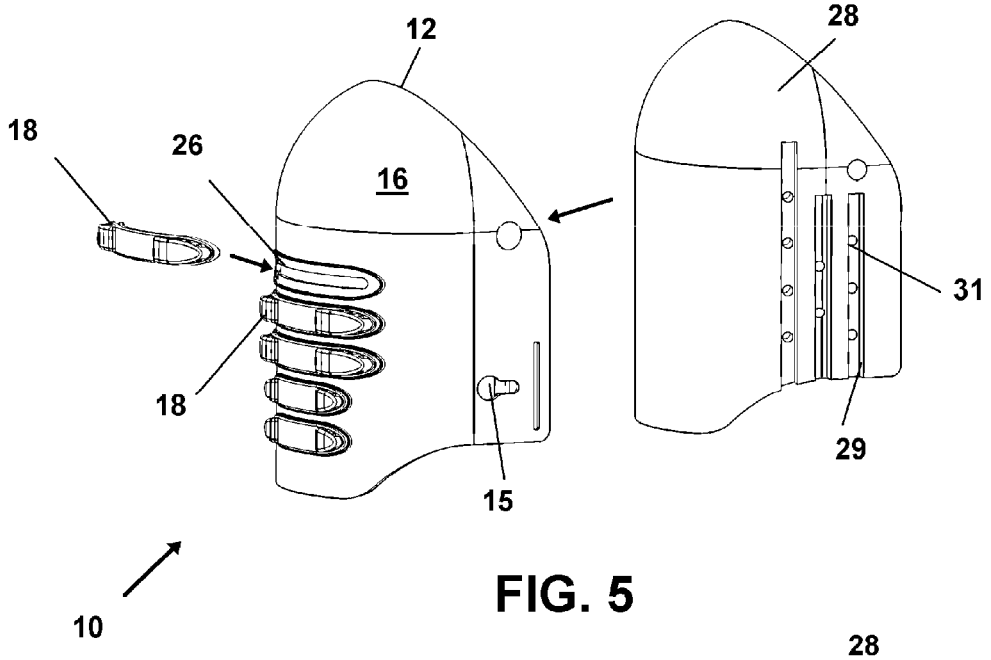
FIG. 5 shows a another particularly preferred mode of the device comprising a removably engageable padding component and means for removable engagement of the stabilizing projections.

In another particularly preferred mode of the device 10 shown in FIG. 5, there is included an engageable pad component 28 formed of foam cushion or other suitable material such as ABSORBATHANE. The pad component 28 is configured for removable engagement to the interior surface 14 of the body 12 of the device 10. In use, with the device 10 in the as-worn position, the pad component 28 is in a sandwiched engagement between the interior surface 14 of the body 12 and the users knee when worn to provide additional support and comfort for the users knee.

The pad component 28 is preferably configured with air cooling means, provided by one or a plurality of air vent channels 29 disposed on the exterior surface of the pad 28, communicating with vent apertures 31. The air vent apertures 31 communicate between channels 29 on the exterior and the apertures 31 on the interior of the pad 28 for communicating air through the pad 28 to the users knee for cooling applications. It is noted that those skilled in the art may recognize other means for air cooling which are slightly or moderately different than the preferred mode shown, however without departing from the scope and intent of the invention, are anticipated within the disclosure.

The pad component 28 is preferably ergonomically shaped to and formed substantially to the shape of human knee to provide the upmost comfort since users may have to maintain a kneeled position for long periods of time. Means for removable engagement of the pad component 28 to the interior surface 14 can include hook and loop fasteners, snap fits, rivets, frictional engagement, removable adhesives, or other suitable means. Briefly, in the kit mode of the device 10 described later in FIG. 10, the means for removable engagement allows the pad component to be replaced as needed. However in other modes those skilled in the art will recognize that the pad component 28 and body 12 can be integrally formed as a unitary structure, and this configuration is also anticipated.

Further, in the current depiction, the device 10 may be configured with means for removable engagement of the stabilizing projections 18 to the body 12 of the device 10. This provides added utility in that the user can replace or exchange the projections 18 as they become worn due to wear and tear.

Figure 10:
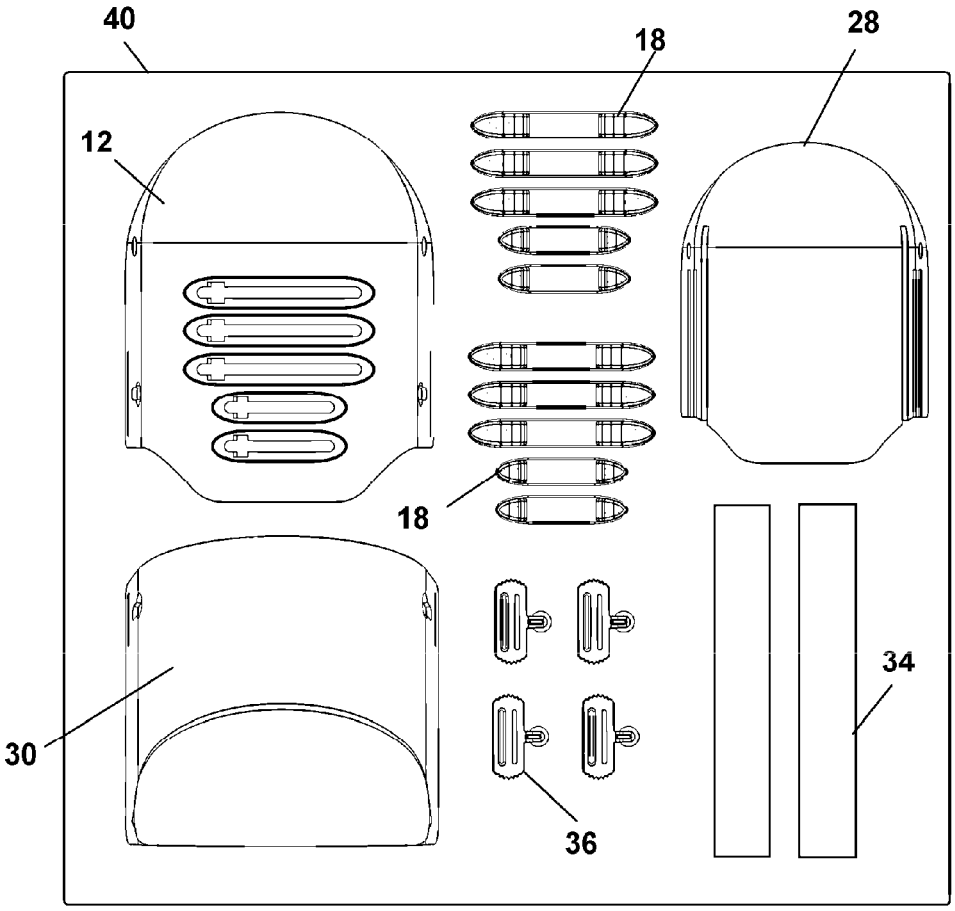
FIG. 10 shows still another particularly preferred kit mode of the device.

Further, the device 10 may be provided in a kit mode shown in FIG. 10 where the user can be provided with a plurality of sets of projections 18, of varying durometer material, thereby allowing the user to customize the device 10 to suit their needs for compressive padding when kneeling and slip resistance when leaning. In the current depiction, the means for removable engagement are provided by engagement of a first side of the projections 28 into receiving apertures 26 disposed on the body 12 of the device 10 which are adapted to removable engage with the first side of the projections. As shown a slot which allows for a compressive engagement of the first end of the projections 18 is employed. However, other means for removable engagement may be employed and are anticipated, for example, hook and loop fasteners, removable adhesives, peel and stick, and the like.

Means for shock absorbency of external forces and the weight of the user against the support surface for reducing user fatigue are additionally preferably provided. Such means for shock absorbency are intended to essentially reduce the perceived weight communicated to the users knee when the users moves around or shifts their weight during a prolonged knee support position.

Figure 7:
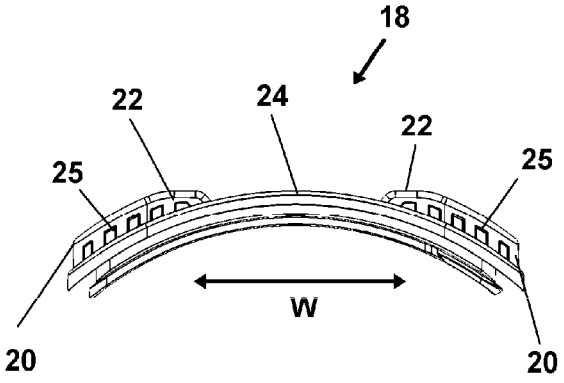
FIG. 7 shows a top view of a particularly preferred mode of the removably engageable stabilizing projection.
Figure 6:
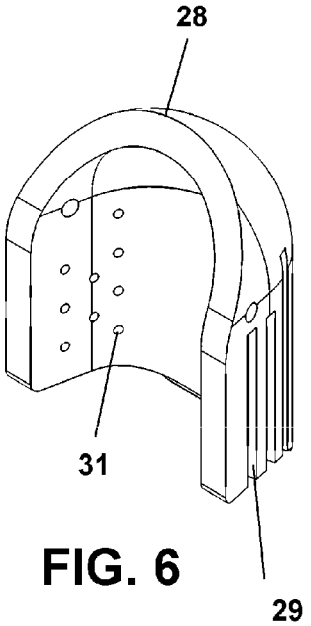
FIG. 6 shows a rear perspective view of the padding component of the mode of the device of FIG. 5, detailing the air vent channels and vent apertures employed as a air cooling means.

In at least one preferred mode as shown currently in FIG. 7, the means for shock absorbency is provided by forming the raised ends 22 at the distal edge surface of the stabilizing projections 18 with a material and construction which is adapted for slight or moderate compression and rebound characteristics when the weight of the user against the device 10 changes or increases, much like a shock absorber.

For example a resilient rubber or similar material such as ABSORBATHANE which will compress under the weight of the user during movement and/or landing on the support surface, and will absorb impact and contact forces when the device contacts the ground are suitable for this purpose.

In addition, the ends 22 can be formed with a plurality of relief channels 25 between the first side used for mounting and the distal side opposite and communicating through the ends 22. This construction essentially configures the ends 22 to be more suitably adapted for slight or moderate compression and rebound characteristics when placed under the load of the users weight. Further, when the relief channels 25 communicate through the surface of the end 22 of the projections 18, it forms somewhat of a suction cup enhancing resistance to sliding which may be desirable in wet or slick surfaces. However, other embodiments envisioned by those skilled in the art which serve the intended purpose of shock absorbency may also be employed, and are anticipated.

In addition, it is anticipated that the material selection of the projections 18 can be selected by the designer to provide means for slip resistance between the contact surfaces 22 of the device and the support surface. For example, the flat planar contact surfaces 22 of the projections 18 may be constructed with a contact layer using a friction enhancing material, such as a "sticky" or soft rubber or the like.

Forming the projections 18 in such a manner can be accomplished by a two shot injection molding process which imbeds a high coefficient of friction material in a layer becoming the surfaces 22 on the distal end of the projections 18. Alternatively, the entire projection 18 can be formed of the friction enhanced material if deemed suitable by the manufacturer. However, other embodiments envisioned by those skilled in the art which serve the intended purpose of reducing slip may also be employed, and are anticipated.

FIG. 8 and FIG. 9 show still another mode of the invention including a upper component 30 which is rotatably engaged to one end of the body 12 of the device 10. The upper component 30 preferably employs a rotational or pivoting engagement such as with a hinge pin 32 or other suitable rotational engagement means. When worn, the upper component 30 is adapted to contact the users thigh, just above the knee, and is intended to provide support and shielding protection to the users thigh when the user is working on their knees.

When working with various tools and hardware in a knee supported as-worn position, the users work space is conventionally directly in an arc in front of the user and the thigh is conventionally exposed. Thus, the engagement of the upper component 30 to the users thigh will provide a protective barrier and will further ensure the users safety as needed. The rotatable engagement will allow the upper component 30 to articulate with the users knee for walking and other natural movements.

Additional utility is provided through the employment of a sealing strap 35 which is configured to engage at or near an upper terminating edge 33 of the upper component 30. In the as-used mode, the sealing strap 35 communicates over the upper terminating edge 33 of the upper component 30 to provide a sealed engagement of the upper component 30 against the users thigh. This provides a means for prevention of the entry of sparks or slag in-between the upper component 30 and thigh during welding, or other debris from lodging between the upper component 30 and the users thigh and is a vast improvement over prior art.

The upper component 30 and body 12 of the device 10 are preferably engageable to the user via one or a plurality of engagement straps 34. The engagement of the straps 34 to the body 12 and upper component 30 can be provided by operative strap receiving slots 17, or through employment of a removable fastener 36. The fastener 36 may include a tongue portion 38 which can be engaged into a mating locking apertures 15 disposed on the side of the body 12 and upper component 30. However those skilled in the art may envision any mating fastener configuration or other means for removable engagement for the intended purpose, and all such means for fastening are anticipated.

FIG. 10 shows a particularly preferred kit mode 40 of the device 10. In this kit 40, the body 12 is configured with means for removable engagement of the stabilizing projections 18 and the padding component 28 as needed to facilitate replacement after they become worn and unusable. As such, the kit 40 preferably includes at least one body 12, one or a plurality of removably engageable padding components 28, one or a plurality of sets of removably engageable stabilizing projections 18, at least one upper component 30, one or a plurality of straps 34, and one or a plurality of strap fasteners 36. The plurality of sets of the stabilizing projections 18 and padding components 28 provided in the kit 40 may be formed of different durometer or hardness materials which provide different friction enhancing and shock absorbency characteristics, and comfort level, respectively, for selective engagement by the user as deemed suitable for the intended purpose. In addition, the dimensions of the projections 18, especially the distance of the channel 24, can be varied to allow the user to select the desired configuration which achieves a contact footprint area which is customizable to their needs.

Those skilled in the art may envision modifications to the kit 40 which may include different suitable combinations of the various components of the invention, and are anticipated. For example, a kit may be provided having only a plurality of different sets of projections 18 which can be providable separately from the body 12 as needed for replacement.

This invention has other applications, potentially, and one skilled in the art could discover these. The explication of the features of this invention does not limit the claims of this application; other applications developed by those skilled in the art will be included in this invention.

It is additionally noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A knee pad apparatus, comprising:

a body having a curved exterior surface extending between side portions and having a curved interior surface;

said curved interior surface configured for an engagement around a knee of a leg of a user to an as-worn position of said knee pad, with said user kneeling thereon and said side portions positioned on opposing sides of said knee when worn;

a plurality of elongated projections each extending from a first end to a second end, each of said projections having a respective first side surface in a respective connection to said curved exterior surface, each of said projections extending a distance away from said curved exterior surface to a respective second side surface opposite a respective first side surface;

each of said elongated projections running along a line between said first end and second end thereof, which is substantially normal to an anatomical longitudinal axis of said leg of said user while said knee pad is in said as-worn position;

each of said projections having a first shoulder portion at a respective said first end thereof and a second shoulder portion at a respective said second end thereof;

each of said projections having a respective recessed channel area positioned in-between each respective said first shoulder portion and respective second shoulder portion thereof;

a planar contact surface positioned on each said first shoulder portion and each said second shoulder portion, each said planar contact surface in a respective position abutting one side of said recessed channel area thereby defining pairs of opposing planar contact surfaces located adjacent opposing sides of said recessed channel area on each respective said projection; and a contact footprint area defined by an area of all of said recessed channel areas positioned on each of said projections, whereby said planar footprint area forms a stable non-rolling contact of said curved exterior surface of said kneepad upon a support surface during use in said as-worn position.

2. A knee pad apparatus of claim 1 additionally comprising:

each respective said recessed channel positioned on each respective said projection, in an alignment with the other respective said recessed channels positioned on the other of said plurality of projections.

3. A knee pad apparatus of claim 2 additionally comprising:

each respective said recessed channel positioned on each respective said projection having a width; and each said width being equal.

4. A knee pad apparatus of claim 3 additionally comprising:

said contact footprint area having a width defined by said width of said recessed channels.

5. A knee pad apparatus of claim 4 additionally comprising:

said connection of each respective said first side surface of each of said elongated projections extending from said exterior surface being in a removable engagement with said body, whereby any of said plurality of elongated projections are replaceable.

6. A knee pad apparatus of claim 5 additionally comprising:

straps for holding said knee pad to said as-worn position.

7. A knee pad apparatus of claim 2 additionally comprising:

said connection of each respective said first side surface of each of said elongated projections extending from said exterior surface being in a removable engagement with said body, whereby any of said plurality of elongated projections are replaceable.

8. A knee pad apparatus of claim 1 additionally comprising:

each respective said recessed channel positioned on each respective said projection having a width; and each said width being equal.

9. A knee pad apparatus of claim 8 additionally comprising:

said contact footprint area having a width defined by said width of said recessed channels.

10. A knee pad apparatus of claim 8 additionally comprising:

said connection of each respective said first side surface of each of said elongated projections extending from said exterior surface being in a removable engagement with said body, whereby any of said plurality of elongated projections are replaceable.

11. A knee pad apparatus of claim 1 additionally comprising:

said connection of each respective said first side surface of each of said elongated projections extending from said exterior surface being in a removable engagement with said body, whereby any of said plurality of elongated projections are replaceable.

12. A knee pad apparatus of claim 1 additionally comprising:

straps for holding said knee pad to said as-worn position.

13. A knee pad apparatus, comprising:

a U-shaped body having an exterior surface, said exterior surface having a curved central portion and extending in-between two side portions;

said U-shaped body having a curved interior surface;

said curved interior surface configured for an engagement around a knee of a user to an as-worn position of said knee pad, with said user kneeling thereon and each of said two side portions adjacent an opposite side of said knee of said user when worn;

a plurality of elongated projections each extending between a first end and a second end, and each extending away from a connection of a respective first side surface with said curved central portion of said exterior surface to a respective second side surface;

each of said elongated projections extending between a respective said first end and a respective said second end along a respective parallel line extending between said two side portions;

each of said projections having a first shoulder portion at a respective said first end thereof positioned adjacent a first of said side portions, and having a respective second shoulder portion at a respective said second end thereof positioned adjacent a second of said side portions;

each of said projections having a respective recessed channel area positioned in-between each respective said first shoulder portion and respective second shoulder portion thereof, and;

each said recessed channel area upon each of said projections being aligned with respective said recessed channel areas on adjacent said projections.

14. The knee pad apparatus of claim 13 wherein said elongated projections are formed of a material which compresses.

15. The knee pad apparatus of claim 14 wherein said connection of said plurality of elongated projections with said curved central portion of said exterior surface is a removable engagement of said first side surface with said curved exterior surface.

16. The knee pad apparatus of claim 13 wherein said material forming said elongated projections is rubber.

17. The knee pad apparatus of claim 16 wherein said connection of said plurality of elongated projections with said curved central portion of said exterior surface is a removable engagement of said first side surface with said curved exterior surface.

18. The knee pad apparatus of claim 13 wherein said connection of said plurality of elongated projections with said curved central portion of said exterior surface is a removable engagement of said first side surface with said curved exterior surface.

* * * * *